US006290515B1

(12) United States Patent
Lee

(10) Patent No.: US 6,290,515 B1
(45) Date of Patent: Sep. 18, 2001

(54) ELECTRICAL CONNECTOR ASSEMBLY HAVING GROUNDING BUSES

(75) Inventor: Wei-Chen Lee, Fremont, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/655,163

(22) Filed: Sep. 5, 2000

(51) Int. Cl.[7] ..... H01R 13/648
(52) U.S. Cl. ..... 439/108; 439/608
(58) Field of Search ..... 439/108, 101, 439/74, 947, 607, 608

(56) References Cited

U.S. PATENT DOCUMENTS 5,618,191 * 4/1997 Chikano et al. ..... 439/108
5,904,581 * 5/1999 Pope et al. ..... 439/74

* cited by examiner

*Primary Examiner*—Brian Sircus
*Assistant Examiner*—Chandrika Prasad
(74) *Attorney, Agent, or Firm*—Wei Te Chung

(57) ABSTRACT

An electrical connector assembly includes a receptacle connector and a mating plug connector. The receptacle connector has an insulative housing forming two elongate sidewalls mounting a plurality of signal terminals therein. An internal wall defining a plurality of grooves for receiving a plurality of first ground buses therein is formed at the center of the insulative housing. The plug connector has a dielectric housing with a base and two rows of tongues extending upward from the base. A plurality of passageways is defined in an outer side surface of each tongue with signal contacts received therein for electrically connecting with the signal terminals of the receptacle connector. A plurality of grooves is defined in an inner side surface of each tongue with a plurality of second ground buses received therein for engaging with the first ground buses of the receptacle connector.

14 Claims, 12 Drawing Sheets

ELECTRICAL CONNECTOR ASSEMBLY HAVING GROUNDING BUSES

BACKGROUND OF THE INVENTION

1. Field of the Invention

The present invention relates to an electrical connector assembly, and particularly to an electrical connector assembly having a plurality of grounding buses for enhancing the signal quality of high frequency signals transmitted therethrough.

2. Prior Art of the Invention

U.S. Pat. No. 5,813,871 discloses an electrical connector assembly for interconnecting two circuit boards which transmit relatively high frequency signals. The electrical connector assembly includes a receptacle connector and a mating plug connector. The plug connector includes a central elongated ground plate which has a plurality of leads along its length for engaging with a circuit board. The leads extend from each side of the ground plate at equal intervals. The plug connector further includes an outer shield that substantially surrounds the plug connector and has a plurality of leads extending from a bottom edge thereof for contacting with corresponding leads of the ground plate.

The receptacle connector includes a base and a plurality of shield plates. The base has a cavity defined therein for receiving a mating portion of the plug connector and a central portion extending into the cavity with a slot defined therein running the entire length of the central portion. When the plug connector and the receptacle connector are fully mated, the elongated ground plate extends well into the slot and is in electrical engagement with each of the shield plates. This provides a relatively short ground path from a first circuit board positioning the receptacle connector to a second circuit board positioning the plug connector, thereby significantly reducing crosstalk between two adjacent signal contacts of the electrical connector assembly.

However, this design provides only one ground plate in the plug connector which only provides a grounding function. Further, once the planarity of the ground plate is lost, a reliable engagement between the ground plate of the plug connector and the shield plates of the receptacle connector cannot be achieved. Hence, an improved electrical connector assembly is required to overcome the disadvantages of the prior art.

BRIEF SUMMARY OF THE INVENTION

A first object of the present invention is to provide an electrical connector assembly having a plurality of grounding buses each having two engaging ribs for achieving reliable grounding performance.

A second object of the present invention is to provide an electrical connector assembly having a plurality of ground buses which can be used for either grounding or power transmission.

To achieve the above objects, an electrical connector assembly in accordance with the present invention comprises a receptacle connector and a mating plug connector. The receptacle connector comprises an insulative housing and a plurality of signal terminals. The insulative housing further has two elongated sidewalls defining a plurality of channels for receiving corresponding signal terminals, and an internal wall between the two elongated sidewalls defining a plurality of grooves for receiving a plurality of first ground buses therein. The plug connector comprises a dielectric housing and a plurality of signal contacts. The dielectric housing defines a base and two rows of tongues extending upward from the base. Each tongue has an outer side surface and an inner side surface. The outer side surface of the tongue defines a plurality of passageways for receiving a plurality of signal contacts which engage with the signal terminals of the receptacle connector, and the inner side surface of the tongue defines a plurality of grooves for receiving a plurality of second ground buses which engage with the first ground buses of the receptacle connector. Each first ground bus includes a mating portion consisting of two engaging ribs each having a free end section and an arcuate section, and each second ground bus includes a mating portion having two ribs for contacting corresponding two engaging ribs of the first ground bus. In assembly, the free end section of the first ground bus is released from being preloaded by the insulative housing, and the arcuate section of each engaging rib engages with a corresponding rib of the mating portion of the second ground bus thereby ensuring a reliable engagement between the first ground buses and second ground buses.

Other objects, advantages and novel features of the invention will become more apparent from the following detailed description of the present embodiment when taken in conjunction with the accompanying drawings.

DETAILED DESCRIPTION OF THE INVENTION

Figure 1:
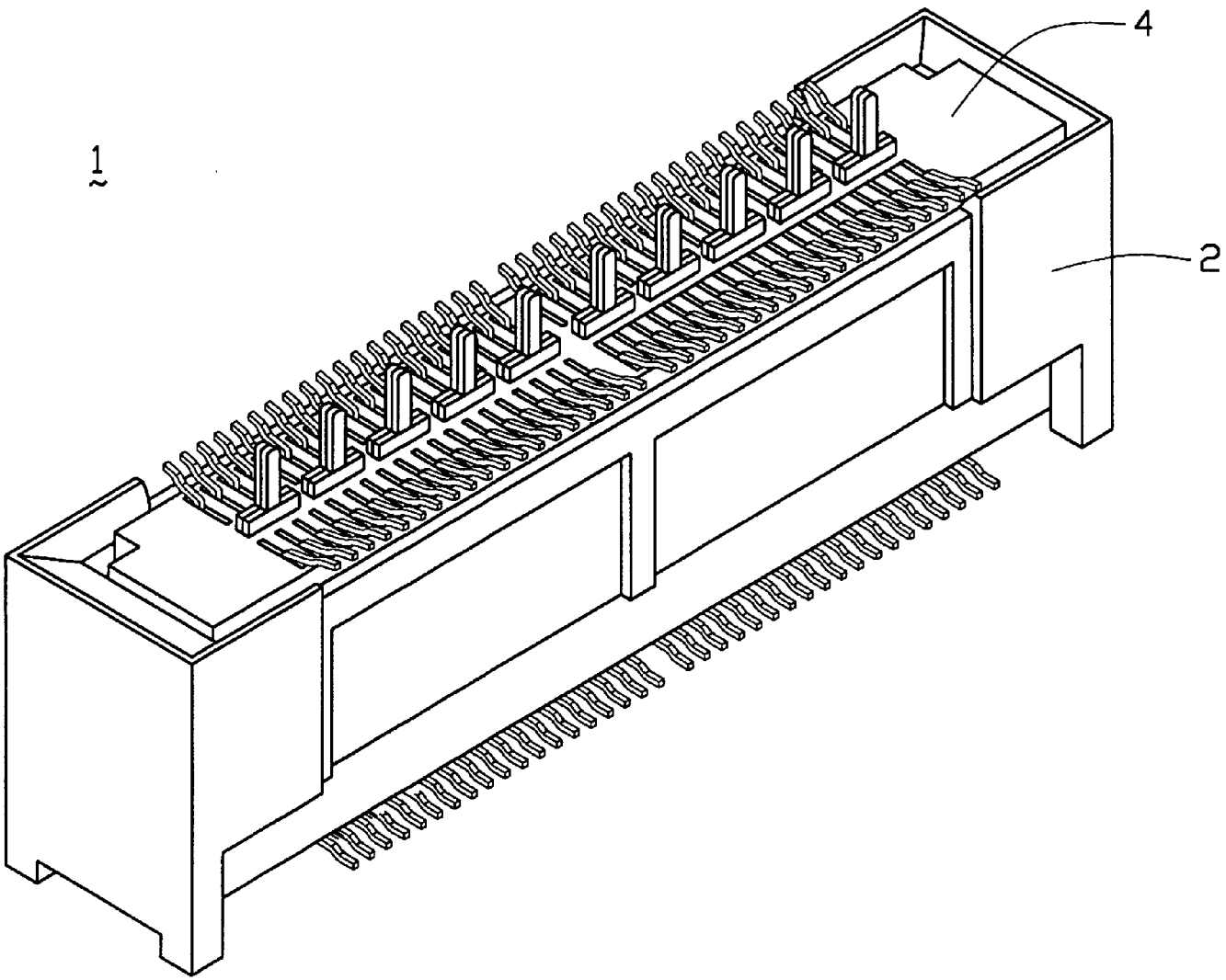
FIG. 1 is a perspective view of a mated electrical connector assembly in accordance with a first embodiment of the present invention.

For facilitating understanding, like components are designated by like reference numerals throughout various embodiments of the present invention as shown in the various drawing figures.

Figure 2:
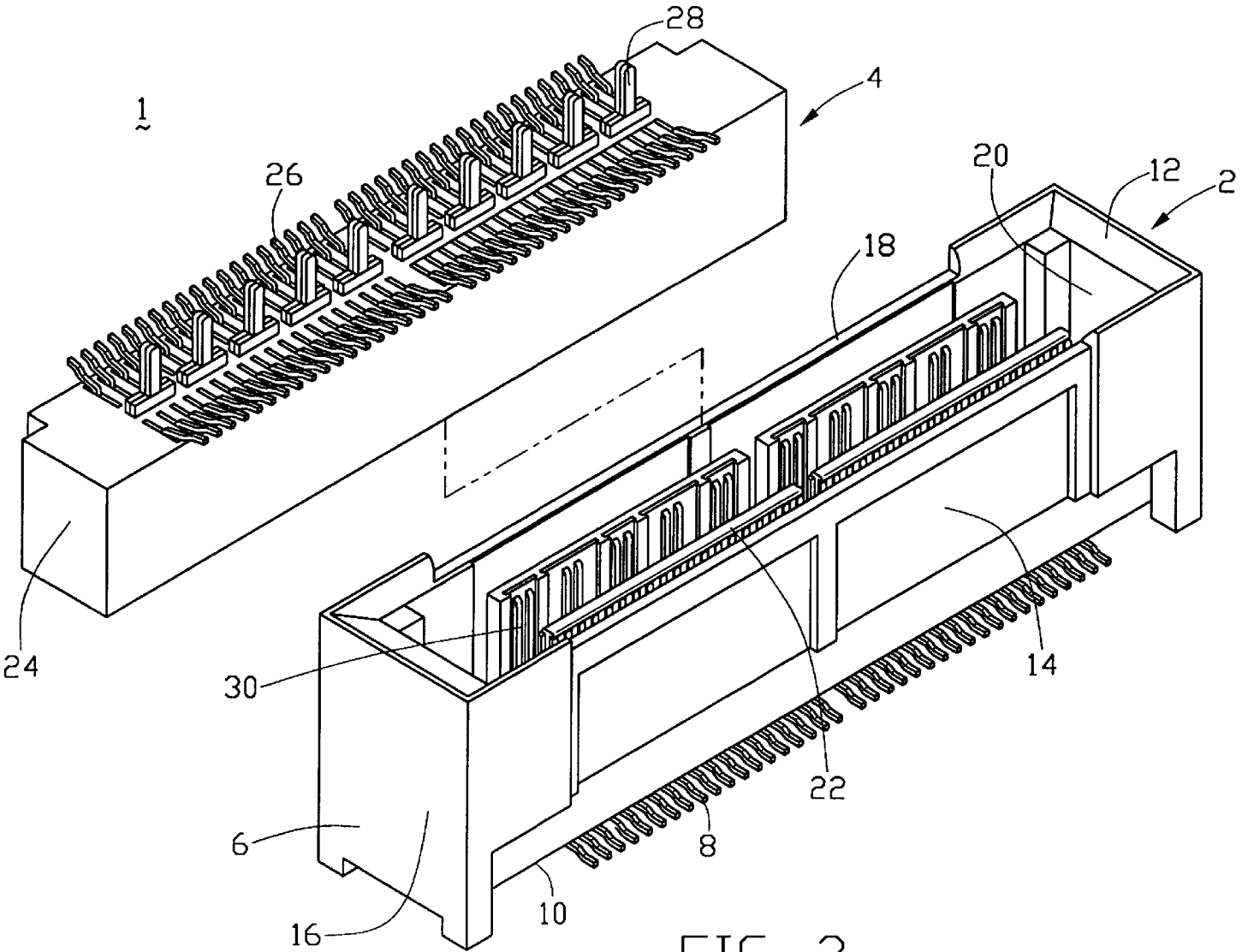
FIG. 2 is a perspective view of the electrical connector assembly of FIG. 1 including a plug connector and a receptacle connector in an unmated state.

Referring to FIGS. 1 and 2, an electrical connector assembly 1 in accordance with a first embodiment of the present invention comprises a plug connector 2 and a mating receptacle connector 4. The plug connector 2 includes a dielectric housing 6 and a plurality of signal contacts 8 received in the dielectric housing 6. The dielectric housing 6 includes a base 10, four sidewalls 12, 14, 16, 18 extending upward from the base 10 to define a receiving cavity 20 therebetween, and four tongues 22 extending upward from the base 10 into the receiving cavity 20 to engage with the mating receptacle connector 4. The receptacle connector 4 includes an insulative housing 24 and a plurality of signal terminals 26 received in the insulative housing 24. A plurality of first ground buses 28 and second ground buses 30 is received in the receptacle connector 4 and in the plug connector 2, respectively.

Figure 3:
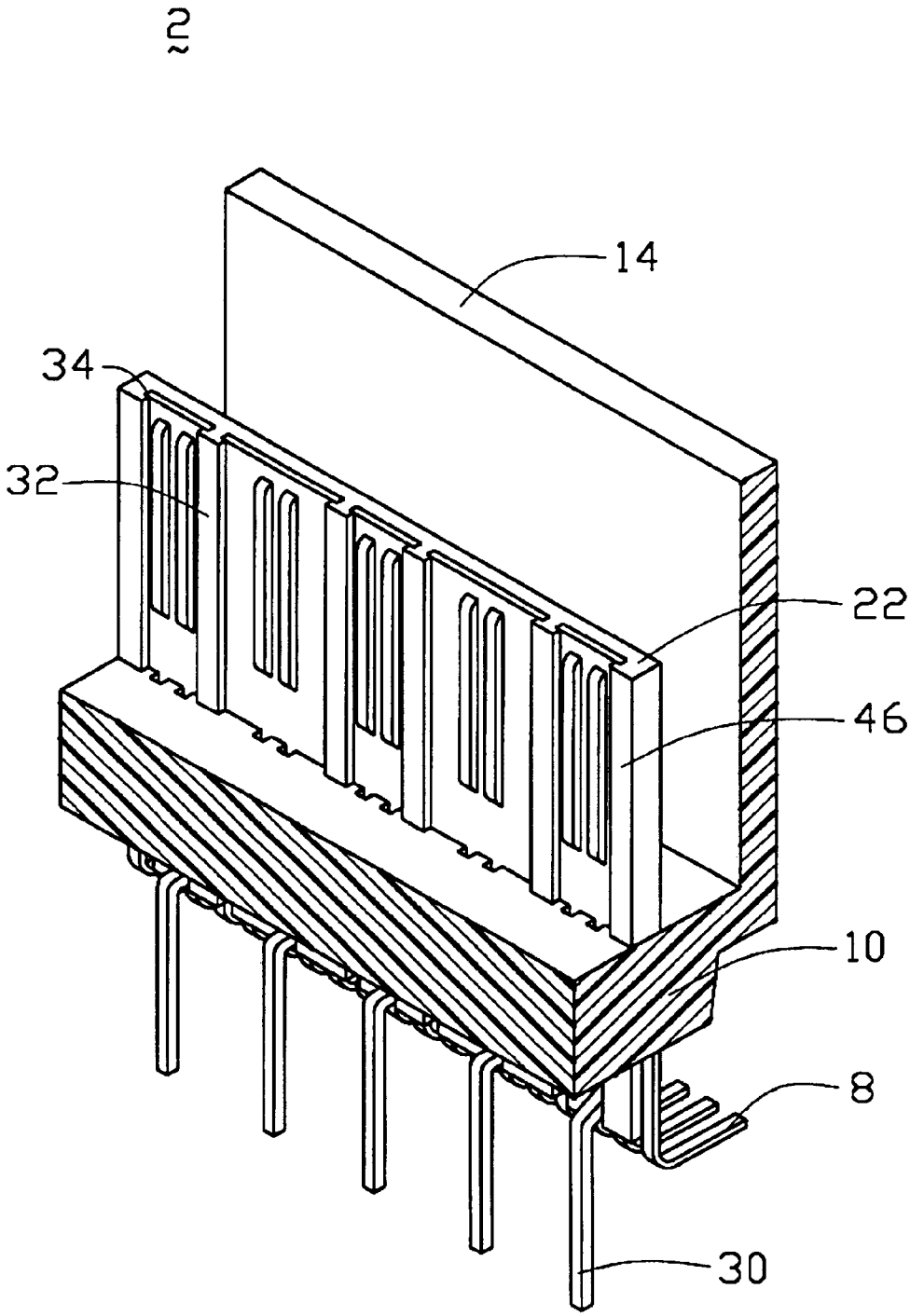
FIG. 3 is a fragmental view of the plug connector of FIG. 2.
Figure 4:
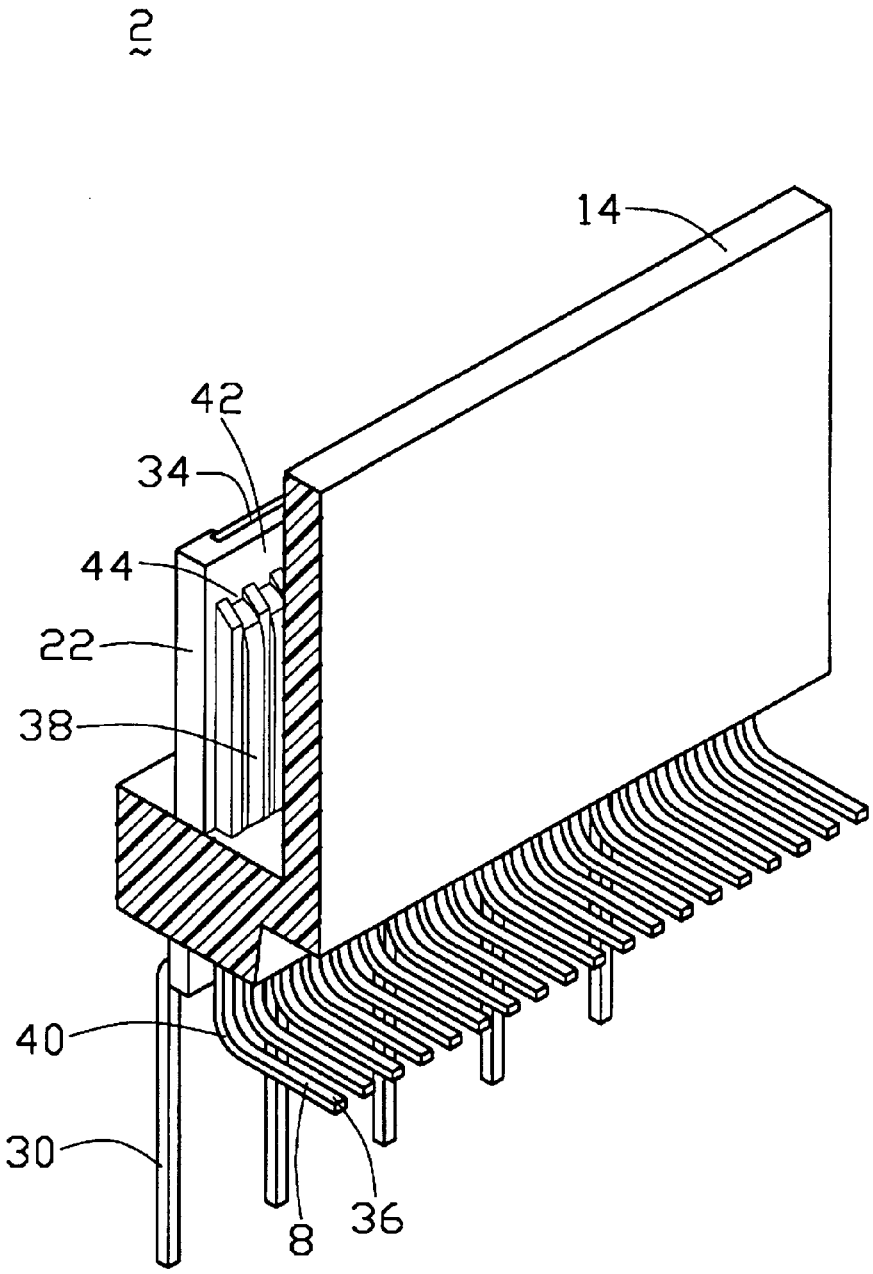
FIG. 4 is a view similar to FIG. 3 but viewed from a different angle.

Referring to FIGS. 3 and 4, a plurality of passageways 44 is defined in an outer side surface 42 of each tongue 22 of the plug connector 2 to receive corresponding signal contacts 8 therein for signal transmission. Five grooves 34 having two different widths are defined in an inner side surface 46 of each tongue 22 for retaining five second ground buses 30, also having two different widths, therein. A plurality of T-shaped ribs 32 is thus defined by the grooves 34. Each second ground bus 30 can also be used to transmit power, and the width of each second ground bus 30 corresponds to several signal contacts 8. In this embodiment, the two widths of second ground buses 30 are arranged in an alternating manner. Each broader second ground bus 30 can protect five signal contacts 8, while each narrower second ground bus 30 can protect three signal contacts 8. Each signal contact 8 includes an engaging section 38 positioned in the passageway 44, a soldering section 36 for being soldered to a printed circuit board (PCB) 90 (FIG. 8), and a curved middle section 40 for connecting the soldering section 36 with the engaging section 38.

Figure 7:
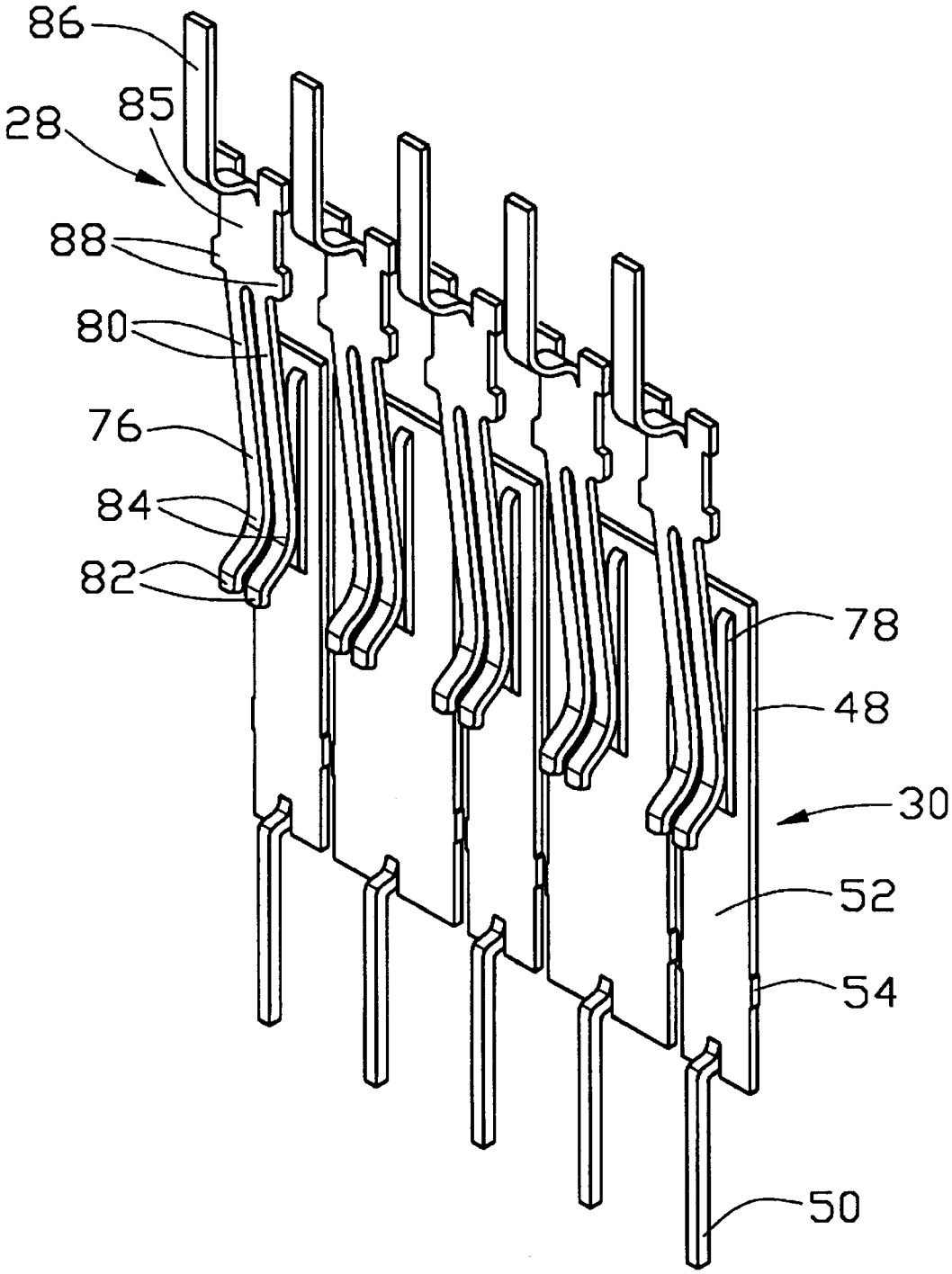
FIG. 7 is a perspective view illustrating the engagement between the first ground buses and second ground buses in accordance with the present invention.

Referring to FIG. 7, each second ground bus 30 includes a mating portion 48 for engaging with a corresponding first ground bus 28, a soldering portion 50 retained in the PCB 90 (FIG. 8), and a joint portion 52 between the mating portion 48 and the soldering portion 50. The joint portion 52 further includes two teeth 54 respectively formed on both sides thereof. The teeth 54 engage with the T-shaped ribs 32 for retaining the second ground buses 30 in the grooves 34. Each mating portion 48 has two ribs 78.

Figure 5:
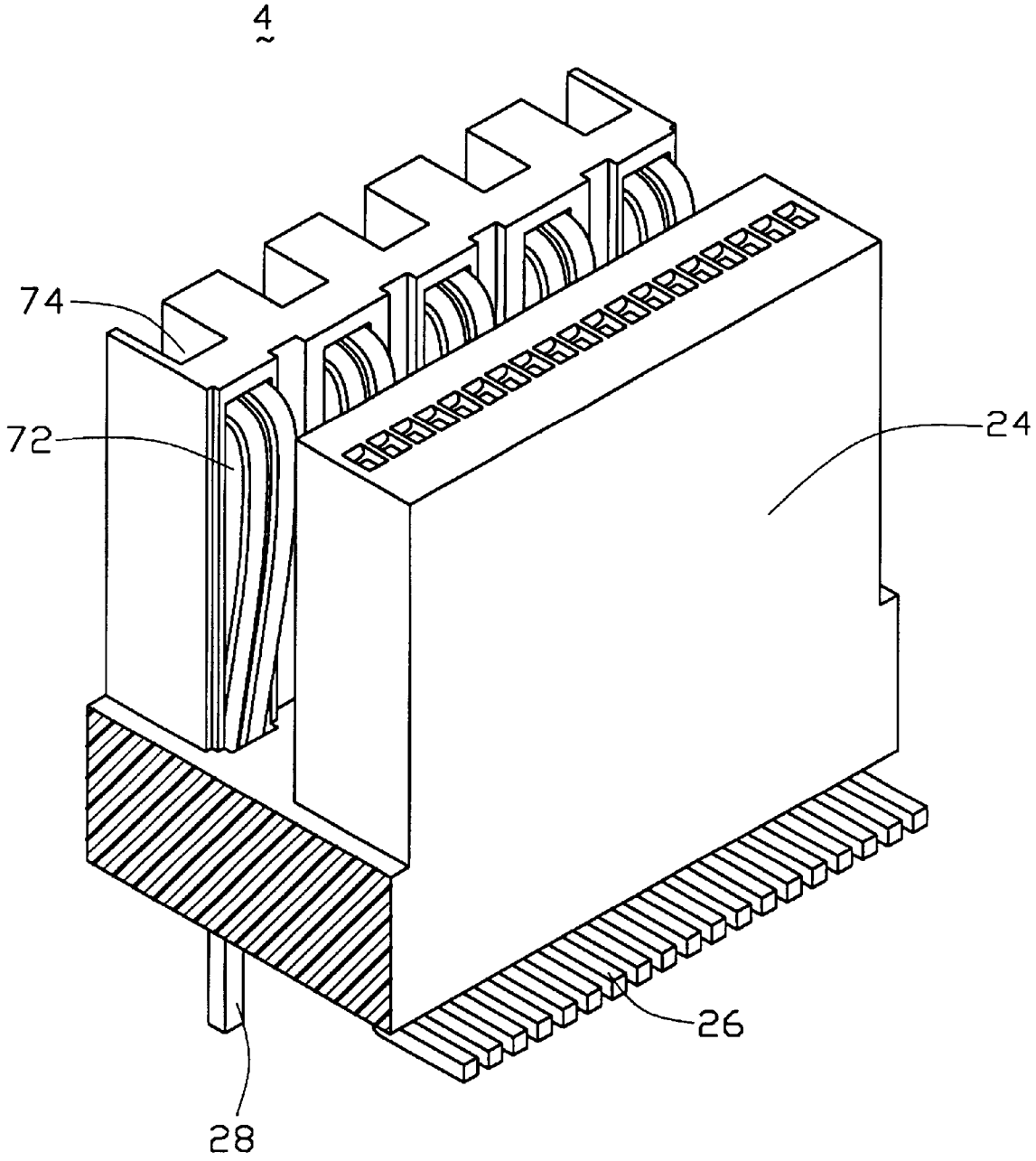
FIG. 5 is a fragmental view of the receptacle connector of FIG. 2.
Figure 6:
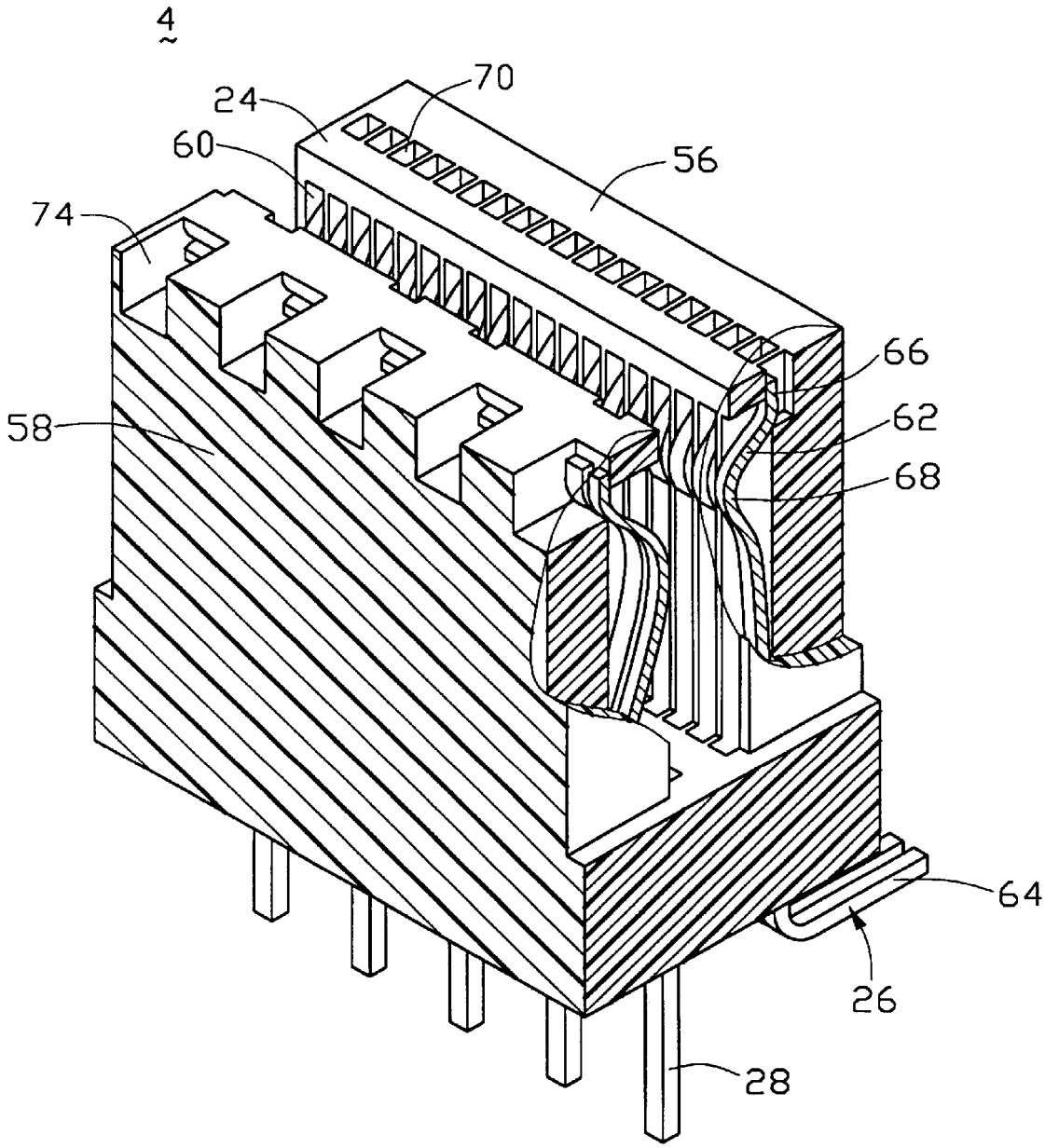
FIG. 6 is a view similar to FIG. 5 but viewed from a different angle and with a portion cut out for illustrating the relationship between the signal terminals, the first ground buses and the housing.

Referring to FIGS. 5 and 6, the insulative housing 24 of the receptacle connector 4 comprises two elongate sidewalls 56 (only one shown) and two lateral end walls (not labeled), together defining a cavity (not labeled) therebetween, and an internal wall 58 upwardly extending into the cavity. A plurality of channels 60 are respectively defined in the two elongate sidewalls 56 with corresponding signal terminals 26 being received therein. An opening 70 is defined at one end of each channel 60. Each signal terminal 26 includes a mating portion 62 and a soldering section 64. The mating portion 62 defines a free end section 66 and an arcuate section 68. The free end section 66 engages with an inner surface of the opening 70 of the channel 60 for preloading before the arcuate sections 68 mates with the signal contact 8 of the plug connector 2. The free end section 66 disengages from the inner surface of the opening 70 when the arcuate section 68 is mated with the signal contact 8. By this design, breakage of the signal terminals 26 is prevented.

The internal wall 58 comprises two rows of grooves 72 (only one row is shown in FIGS. 5 and 6) each defining a recess 74 at one end thereof. As is clearly shown in FIG. 7, each first ground bus 28 includes a mating portion 76 including two engaging ribs 80 each having a free end section 82 and an arcuate section 84, a soldering portion 86 for mating with a PCB 92 (FIG. 8), and a retention portion 85 between the mating portion 76 and the soldering portion 86. Two teeth 88 are formed on both sides of the retention portion 85. The two teeth 88 interferentially engage with the groove 72 to retain the first ground bus 28 therein. In assembly, the free end section 82 is preloaded by the recess 74, and the two arcuate sections 84 of the engaging ribs 80 of the mating portion 76 engage with the two ribs 78 of the corresponding second ground bus 30 of the plug connector 2.

The signal contacts 8 of the plug connector 2, the signal terminals 26 of the receptacle connector 4, and the first ground buses 28 and second ground buses 30 are formed, so the reliability thereof is better than if they were stamped. The first ground buses 28 and second ground buses 30 can serve as a grounding plane and an electrical connector ground, or for electrical power transmission. First ground buses 28 and second ground buses 30 are arranged back-to-back in pairs, pairs of their soldering portions 86 and 50 engaging with signal holes 96, 94 in the PCBs 92, 90. Therefore, the footprint of the electrical connector assembly on the PCBs is compatible with the prior art assembly.

Figure 8:
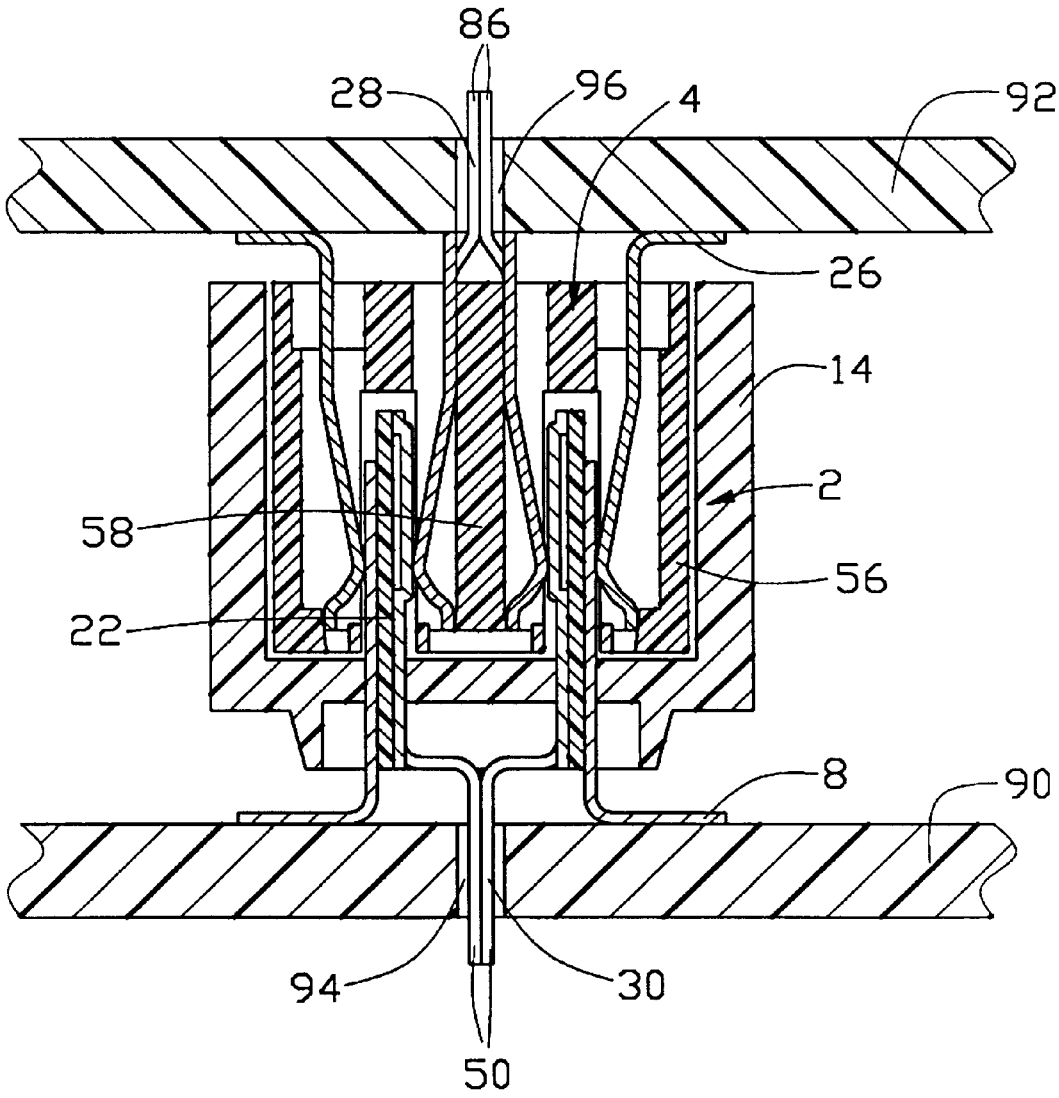
FIG. 8 is a cross-sectional view of the electrical connector assembly of FIG. 1 mated together and mounted to two different circuit boards.

Referring to FIG. 8, in use, the plug connector 2 soldered to the PCB 90 mates with the receptacle connector 4 soldered to the PCB 92 whereby the signal contacts 8 engage with the signal terminals 26. Thus, an electrical circuit is established between the PCBs 90 and 92 via the contacts 8 and the terminals 26. In addition, the first ground buses 28 and second ground buses contact each other. The two rows of soldering portions 86 and 50 of the respective ground buses 28 and 30 together extend through corresponding holes 96 and 94 defined in the respective PCBs 92 and 90.

Figure 9:
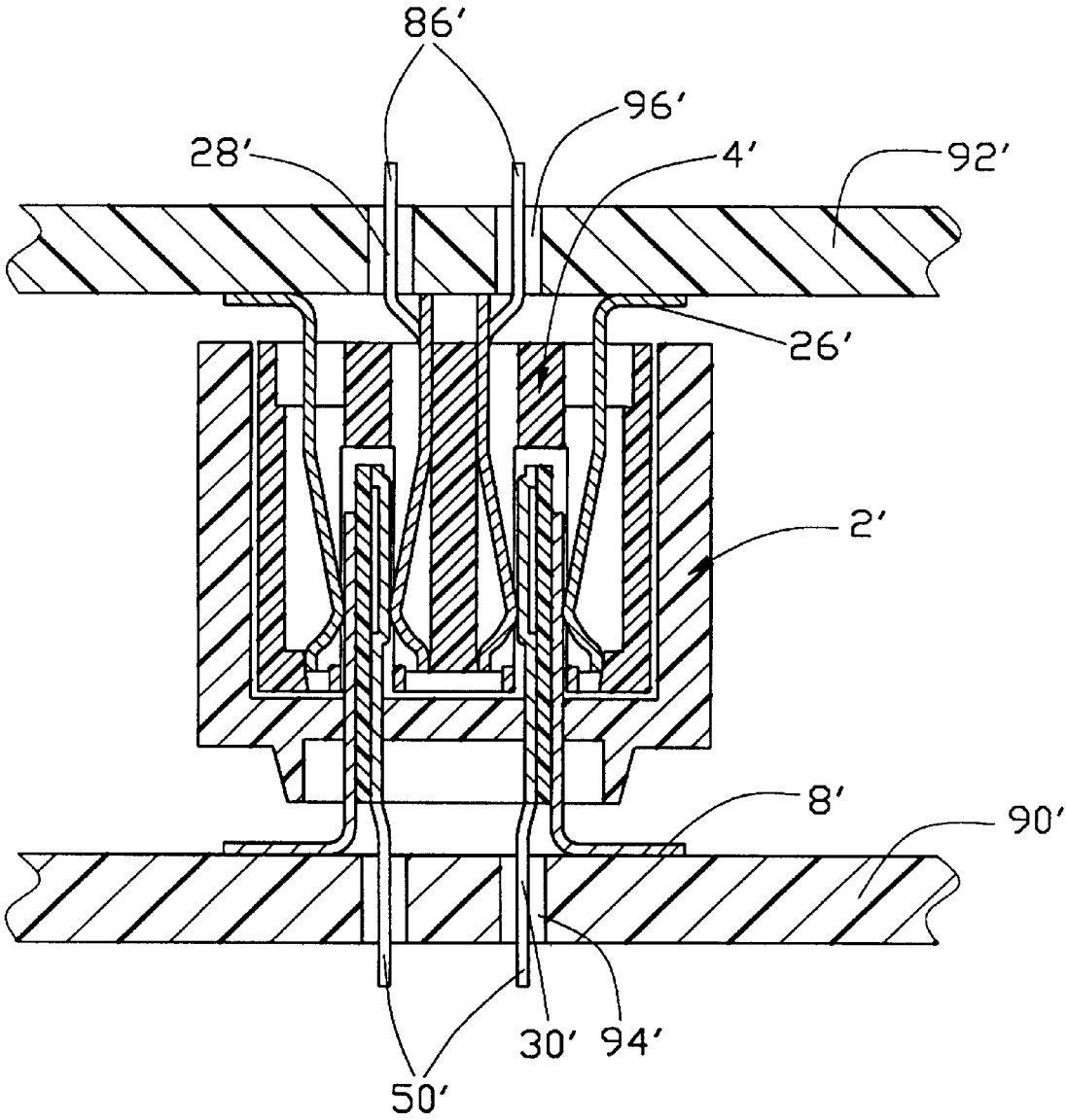
FIG. 9 is a cross-sectional view of an electrical connector assembly in accordance with a second embodiment of the present invention mounted to two circuit boards.

FIG. 9 is a second embodiment of the present invention, which is similar to the first embodiment. When the plug connector 2' mates with the receptacle connector 4', the first ground buses 28' and second ground buses 30' engage with each other. However, the two rows of the soldering portions 86' and 50' are respectively separated from each other and extend through the corresponding holes 96' and 94' defined in the PCBs 92' and 90'. The first and second embodiments are for use in situations where the PCBs 90 and 92 are parallel to each other.

Figure 10:
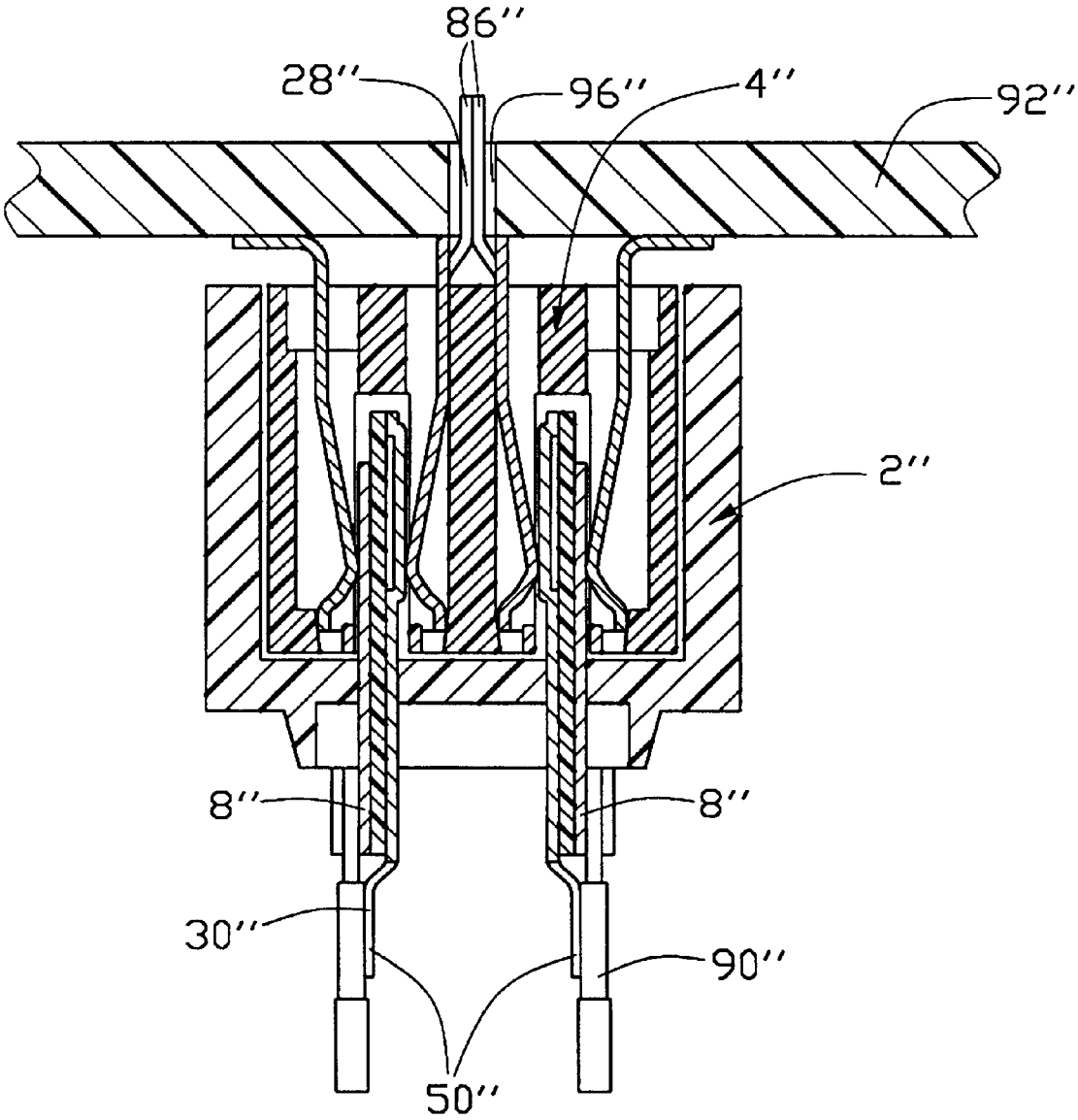
FIG. 10 is a cross-sectional view of an electrical connector assembly in accordance with a third embodiment of the present invention.

FIG. 10 is the third embodiment of the present invention, wherein the PCB 92" engaging with the receptacle connector 4" is perpendicular to two PCBs 90" which each form part of a cable assembly (not labeled) terminated to the plug connector 2". In this embodiment, each row of the signal contacts 8" and the soldering portions 50" of the second ground buses 30" are soldered to one PCB 90", and the two rows of the soldering portions 86" of the first ground buses 28" together extend through one row of corresponding holes 96" in the PCB 92".

Figure 11:
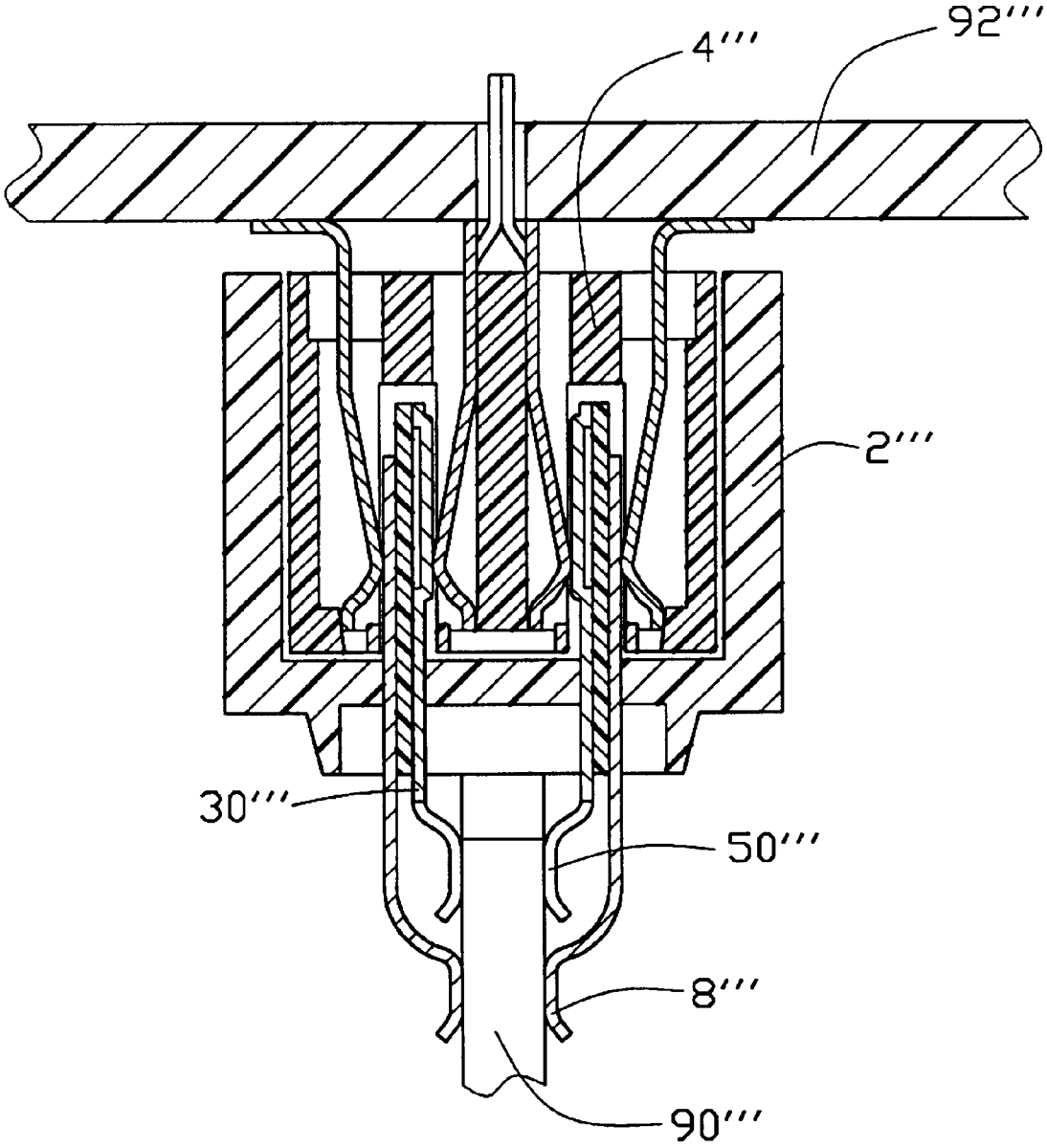
FIG. 11 is a cross-sectional view of an electrical connector assembly in accordance with a fourth embodiment of the present invention.

FIG. 11 is a fourth embodiment of the present invention wherein the plug connector 2''' is configured as a right angle connector. When the plug connector 2''' mates with the receptacle connector 4''', the two rows of signal contacts 8''' and the soldering portions 50''' of the second ground buses 30''' are soldered to both sides of the PCB 90''' which connects perpendicular to the PCB 92'''.

Figure 12:
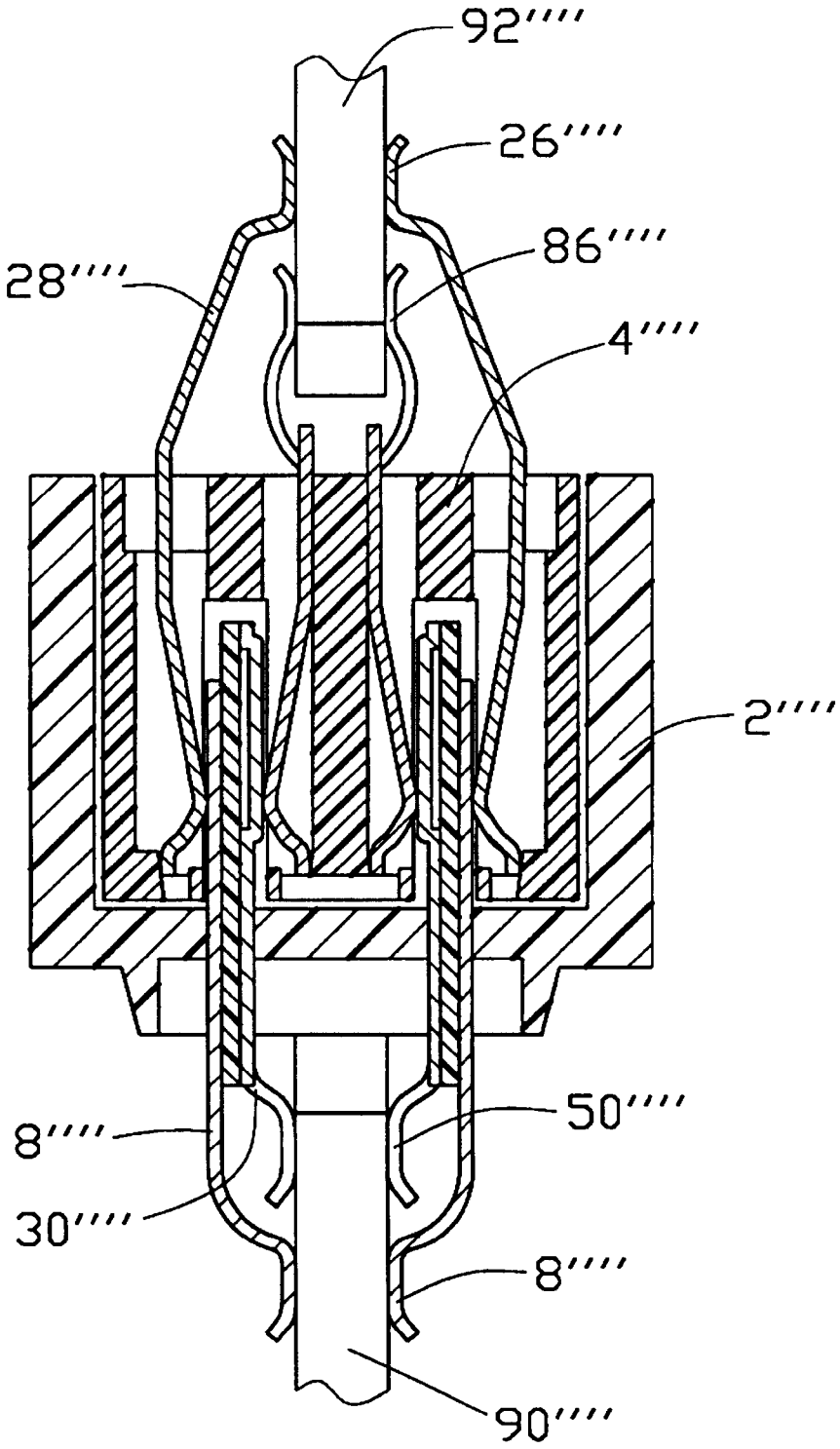
FIG. 12 is a cross-sectional view of an electrical connector assembly in accordance with a fifth embodiment of the present invention.

FIG. 12 is a fifth embodiment of the present invention. When the plug connector 2'''' mates with the receptacle connector 4'''', the two rows of signal contacts 8'''' and signal terminals 26"" engage with each other, and the soldering portions 50"" and 86"" of the second and first ground buses 30"" and 28"" are soldered to both sides of the respective PCBs 90"" and 92"".

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a receptacle connector having an insulative housing, a plurality of terminals and a plurality of first ground buses, each first ground bus including two engaging ribs, said insulative housing comprising two elongated sidewalls defining a plurality of channels for receiving the corresponding terminals and an internal wall between the two elongated sidewalls for receiving the plurality of first ground buses; and a plug connector being used for mating with the receptacle connector and having a dielectric housing, a plurality of contacts and a plurality of second ground buses, each second ground bus including two ribs alignedly contacted with corresponding engaging ribs of the first ground bus, said dielectric housing comprising a base and two rows of tongues extending from the base and engaging with the two elongated sidewalls and the internal wall, each tongue having two opposite outer and inner surfaces, wherein the outer surface defines a plurality of passageways for receiving the contacts to engage with the terminals, and the inner surface forms a plurality of grooves for receiving the plurality of second ground buses to engage with the first ground buses;

wherein respective widths of the second ground buses are individually differently sized to span a range corresponding to a width of one contact or a width of more contacts.

2. The electrical connector assembly as claimed in claim 1, wherein each ground bus can be used as a grounding plane and as an electrical ground connector or for electrical power transmission.

3. The electrical connector assembly as claimed in claim 1, wherein the internal wall of the receptacle connector defines a plurality of grooves for receiving the plurality of first ground buses.

4. The electrical connector assembly as claimed in claim 3, wherein the first ground bus has a mating portion, a soldering portion and two teeth located between the mating portion and the soldering portion to engage with the grooves for retaining the plurality of first ground bus in the receptacle connector.

5. The electrical connector assembly as claimed in claim 4, wherein the two engaging ribs constitute the mating portion, each engaging rib includes a free end section and an arcuate section for mating with the second ground bus, and each groove defines a recess at one end thereof receiving and preloading the free end section.

6. The electrical connector assembly as claimed in claim 5, wherein a plurality of T-shaped ribs is located between each two adjacent grooves of the plug connector.

7. The electrical connector assembly as claimed in claim 6, wherein each second ground bus has a mating portion, a soldering portion and a joint portion located between the mating portion and the soldering portion, the joint portion having two teeth on both sides thereof to engage with said T-shaped rib.

8. The electrical connector assembly as claimed in claim 1, wherein each terminal has a free end section, and each channel of the receptacle connector defines an opening for preloading the free end section.

9. An electrical connector assembly comprising:

an elongated receptacle connector having an insulative housing, a plurality of terminals and a plurality of first ground buses received in the insulative housing, said terminals being arranged in at least two rows along the elongated direction, said first ground buses located between the terminals;

an elongated plug connector having a dielectric housing, a plurality of contacts and a plurality of second ground buses received in the dielectric housing, said contacts being arranged in at least two rows along the elongated direction, said second ground buses located between the contacts;

wherein when the plug connector mates with the receptacle connector, the terminals engage with the contacts for signal transferring, and the first ground buses and second ground buses respectively engage for grounding or power; and wherein each first ground buses defines two ribs alignedly contacted with corresponding ribs of each second ground buses, and respective widths of the second ground buses are individually differently sized to span a range corresponding to a width of one contact or a width of more contacts.

10. The electrical connector assembly as claimed in claim 9, wherein each rib of each first ground bus includes a free end section for preloading with the insulative housing and an arcuate section for engaging.

11. The electrical connector assembly as claimed in claim 9, wherein all the terminals are preloaded to prevent damage during mating.

12. The electrical connector assembly as claimed in claim 9, wherein the width of the first ground buses and second ground buses can be changed as required.

13. An electrical connector assembly comprising:

a plug connector comprising:

a dielectric housing having a base, a sidewall and a tongue both projecting from the base and defining a space therebetween, the tongue having opposite first and second faces;

a ground bus fixed to the first face, the ground bus comprising at least a pair of ribs projecting therefrom in a direction away from the first face; and a plurality of signal contacts fixed to the second face and facing the sidewall; and a receptacle connector mating with the plug connector, comprising:

an insulative housing having a bottom wall, first and second sidewalls projecting from the bottom wall, wherein the first sidewall of the insulative housing of the receptacle connector being fitted within the space defined between the sidewall and tongue of the dielectric housing of the plug connector;

a plurality of signal terminals received in the first wall of the housing of the receptacle connector and in electrical connection with corresponding signal contacts of the plug connector; and a ground bus received in the second wall of the insulative housing of the receptacle connector, the ground bus of the receptacle connector comprising two ribs alignedly contacted with corresponding ribs of plug connector, and being in electrical engagement with the pair of ribs of the ground bus of the receptacle connector;

wherein a width of the ground bus of the plug connector spans a range corresponding to a width of one contact or a width of more contacts.

14. An electrical connector assembly comprising:

a receptacle connector including an insulative housing with a pair of sidewalls and an internal wall between said pair of sidewalls;

two rows of terminals oppositely disposed on opposite inner surfaces of the pair of sidewalls, respectively;

two rows of first ground buses oppositely disposed on two opposite surfaces of the internal wall;

a plug connector including a dielectric housing with a pair of spaced tongues, said pair of tongues defining an external dimension which allows said pair of tongues to be snugly received between said pair of sidewalls of the receptacle connector, and further defining an internal dimension which allows the internal wall of the receptacle connector to be snugly received between said pair of tongues;

two rows of contacts disposed on opposite outer surfaces of said pair of tongues, and respectively engaged with the corresponding terminals;

two rows of second ground buses disposed on opposite inner surfaces of said pair of tongues, and respectively engaged with the corresponding first ground buses; wherein tails of said two rows of first ground buses are joined as one, and tails of said two rows of second ground buses are also joined as one aligned with said one of the first ground buses.

* * * * *